United States Patent [19]

Hsu

[11] Patent Number: 4,998,423

[45] Date of Patent: Mar. 12, 1991

[54] RING SHAPED HANGING LOCK WITH REPLACEABLE CORE

[76] Inventor: Fong S. Hsu, 6th Fl., No. 20, Alley 7, Ln. 35, Jen Ai Rd., Sec. 4, Taipei, Taiwan

[21] Appl. No.: 461,369

[22] Filed: Jan. 5, 1990

[51] Int. Cl.[5] ..... E05B 67/28

[52] U.S. Cl. ..... 70/40; 70/48; 70/369

[58] Field of Search ..... 70/40, 48, 369–371

[56] References Cited

U.S. PATENT DOCUMENTS

| | | | |
|---|---|---|---|
| 521,994 | 6/1894 | Sparks | 70/40 |
| 823,919 | 6/1906 | Caldwell | 70/40 |
| 862,690 | 8/1907 | Ackerman | 70/40 |
| 936,863 | 10/1909 | Byrne | 70/40 |
| 1,463,768 | 7/1923 | Wieland | 70/48 |
| 1,490,453 | 4/1924 | Caldwell | 70/40 |
| 3,735,612 | 5/1973 | Popovici | 70/369 X |
| 3,785,182 | 1/1974 | Van Lahr | 70/369 X |
| 4,697,444 | 10/1987 | Maffey | 70/371 X |
| 4,776,187 | 10/1988 | Evans et al. | 70/369 X |

FOREIGN PATENT DOCUMENTS

| | | | |
|---|---|---|---|
| 2115149 | 10/1972 | Fed. Rep. of Germany | 70/43 |

*Primary Examiner*—Gary L. Smith
*Assistant Examiner*—Suzanne L. Dino
*Attorney, Agent, or Firm*—Ostrolenk, Faber, Gerb & Soffen

[57] ABSTRACT

A ring shaped hanging lock which includes a casing, a replaceable core and a ring shaped shackle. A tool can be used to remove the core when the shackle is in an intermediate position. But when the lock is open or closed, an opening is obstructed by the shackle such that the tool cannot be inserted into the casing.

15 Claims, 2 Drawing Sheets

RING SHAPED HANGING LOCK WITH REPLACEABLE CORE

BACKGROUND OF THE INVENTION

The present invention relates to an easy-to-operate ring-shaped hanging lock with a replaceable core.

A conventional hanging lock generally comprises a U-shaped locking latch. However, a relatively large space exists within such a latch. A wrench or similar tool can be easily inserted into the space and acquire a torque support point, permitting the lock to be broken by an unauthorized person.

Accordingly, a more secure ring-shaped lock with a small space has been developed. But the known ring-shaped lock is fixedly assembled, i.e., the lock core and lock casing thereof are fixedly mounted and cannot be disassembled. Once the key for the lock core is duplicated or security is doubtful, the whole lock must be replaced. This is unnecessarily wasteful.

SUMMARY OF THE INVENTION

It is therefore an object of the present invention to provide a ring-shaped lock with a core which can be easily replaced. When the lock core is the only part that has to be replaced, great costs can be avoided.

Another object of the present invention is to provide a lock with a lock core which can be replaced without discontinuing use of the lock.

The present invention relates to a ring-shaped hanging lock, which includes: a casing with an open portion, a first opening and a second opening; a ring shaped shackle with an open portion, the shackle being slidable within the casing between an open position, an intermediate position and a closed position, the open portion of the shackle being aligned with the open portion of the casing when the shackle is in the open position, the open portion of the casing being closed by the shackle when the shackle is in the intermediate and closed positions, the second opening of the casing being obstructed by the shackle such that a tool cannot be inserted into the casing through the second opening when the shackle is in the open and closed positions; a latch which is movable between a locked position and an unlocked position, the latch being in the locked position and engaged with the shackle so as to prevent the shackle from moving to the intermediate position when the shackle is in the closed position, the latch being disengaged from the shackle when the latch is in the unlocked position; a control cam for moving the latch from the locked position to the unlocked position and for moving the shackle; a replaceable core for operating the control cam; and securing means for securing the core within the casing, the securing means being aligned with the second opening such that the securing means can be operated upon by the tool to permit removal of the core from the casing through the first opening when the shackle is in the intermediate position.

Preferably, the securing means includes a core receiving plate with an opening for receiving the core, the core receiving plate including a locking hole, the core including a hole which is aligned with the locking hole, the securing means further including a screw which is threaded into the locking hole and the core hole, the screw being removable from the core hole by the tool when the shackle is in the intermediate position.

Other features and advantages of the present invention will become apparent from the following description of a preferred embodiment of the invention, with reference to the accompanying drawings.

DETAILED DESCRIPTION OF THE PREFERRED EMBODIMENT

Figure 1:
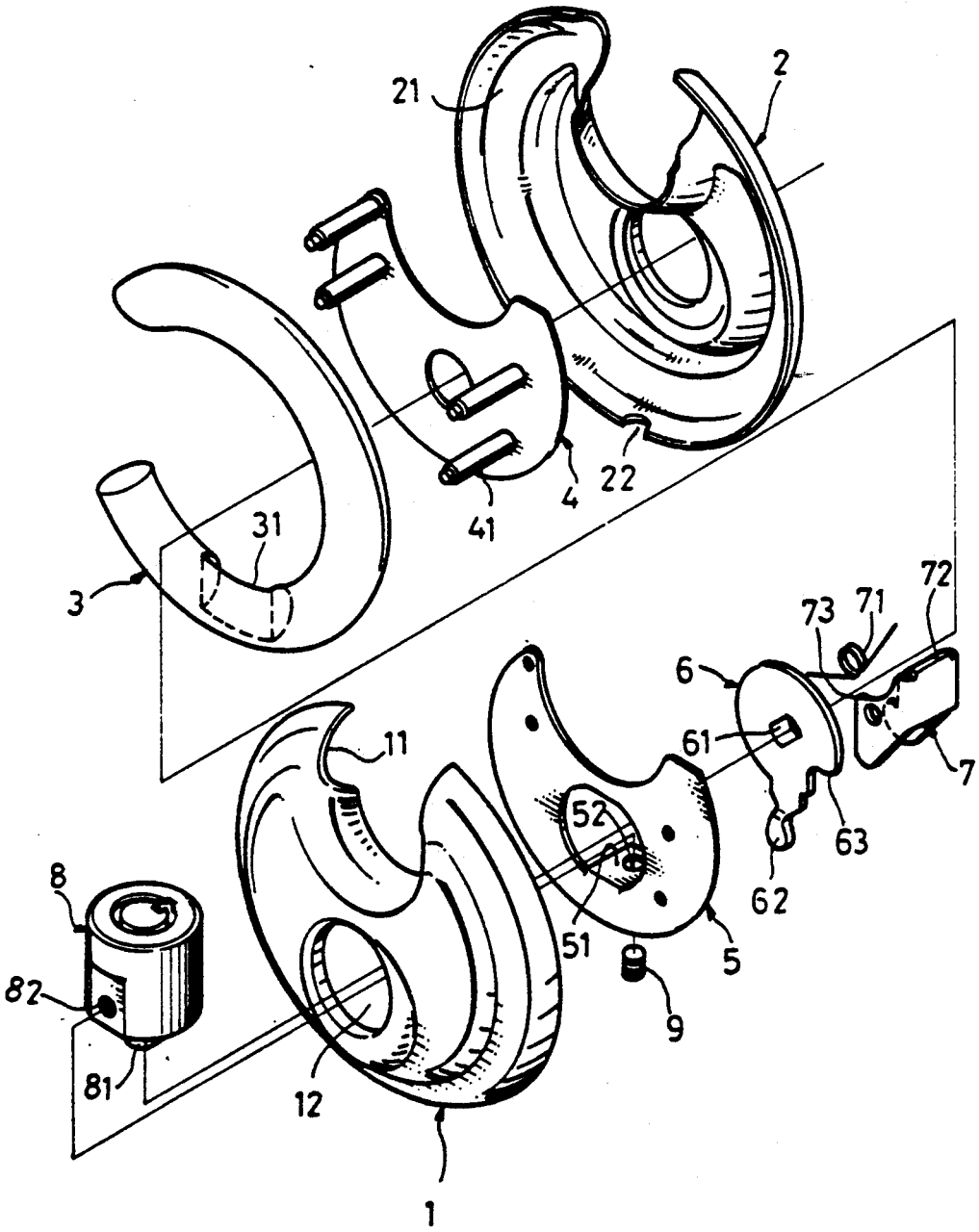
FIG. 1 is a perspective, exploded view of a lock in accordance with the present invention.

Referring to FIG. 1, a lock in accordance with the present invention includes an upper cover 1 and a lower cover 2. The lower cover 2 is associated with the upper cover 1 to form a lock casing. The upper cover 1 has a peripheral annular groove 11. The lower cover 2 has a corresponding peripheral annular groove 21. The annular grooves 11, 21 cooperatively form a ring trough. The lower cover 2 has a lower semicircular hole 22. The upper cover 1 has a corresponding semicircular hole (not shown) which cooperates with the hole 22 to form a circular hole. A lock hole 12 is formed on the upper cover 1.

Figure 2:
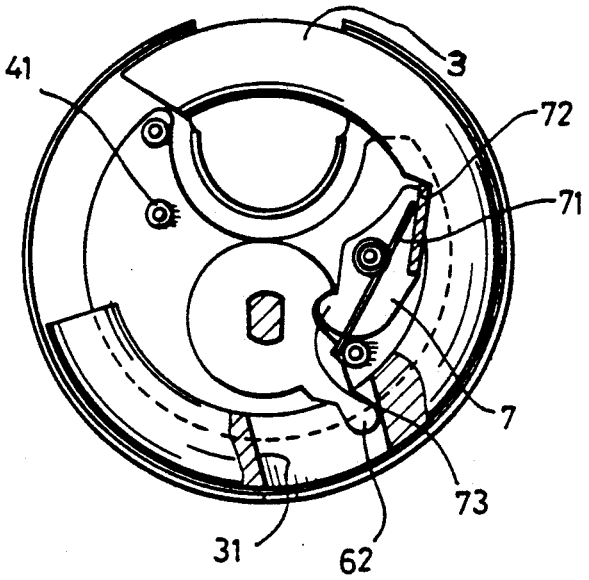
FIG. 2 is a sectional view of the lock of FIG. 1, in a locked condition.
Figure 3:
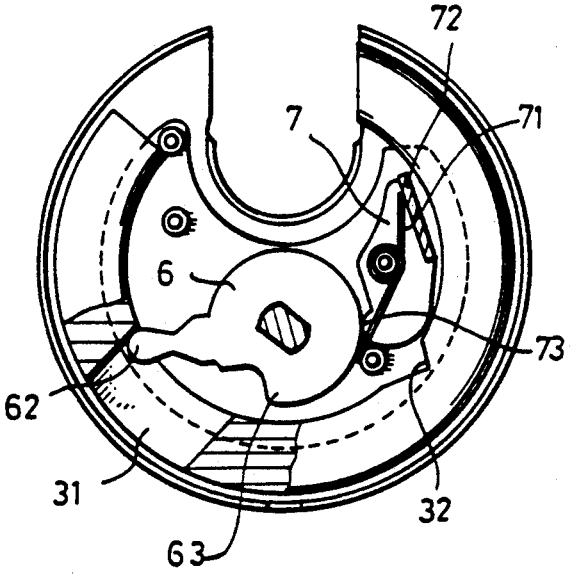
FIG. 3 is a sectional view of the lock of FIG. 1, in a unlocked condition.
Figure 4:
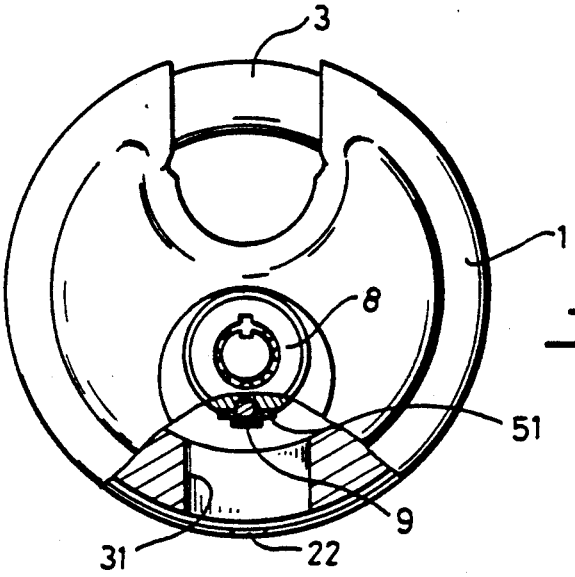
FIG. 4 is a partially sectional view of the lock of FIG. 1, in a condition for changing the lock core.

A ring-shaped shackle 3 is slidably received within the ring trough. The shackle 3 is formed with a recess 31 and an engaging edge 32 (FIGS. 2 and 3).

An associating plate 4 has a plurality of associating pins 41 on one side thereof. The associating pins 41 are joined to a core receiving plate 5 at their free ends such that the associating plate 4 is spaced from and parallel to the plate 5. The plate 5 has a central hole at which an internally bent plate 51 is disposed. The bent plate 51 is formed with a locking hole 52.

The lock further includes a spring latch 7 which is fitted to a spring 71. The latch 7 is secured to an associating pin, whereby the spring 71 causes a stop edge 72 to engage with the engaging edge 32 of the shackle 3 (FIG. 2). A restricting edge 73 is formed on the stop block 7 opposite to the stop edge 72.

A control cam 6 has a drive hole 61 formed on a central portion thereof, a projection 62 extended from a side portion thereof and a locking edge 63 formed on a lateral portion thereof. The locking edge 63 slidably engages with the restricting edge 73.

A lock core 8 having a control rod 81 at one end thereof is placed into the lock hole 12 with the control rod 81 extending through the drive hole 61. In operation, the rod 81 rotates the cam 6.

A threaded hole 82 is formed on a lower portion of the core 8 in alignment with the locking hole 52. A hexagonal screw 9 can pass through the holes 52, 82 to secure the core 8 in the lock casing.

Referring to FIG. 2, locking is obtained when the engaging edge 32 of the latch 3 is stopped by the stop edge 72 of the latch or stop block 7. To unlock the lock, the user may use a key to drive the lock core 8 and rotate the cam 6, causing the locking edge 63 to rotate the restricting edge 73 and thereby release the stop edge 72 from the engaging edge 32. Thereafter, the projection 62 can drive the shackle 3 to form the unlocking condition (FIG. 3). All elements are restored to the locking condition shown in FIG. 2 by rotating in reverse.

When in the locking condition, the circular hole 22 is shielded by the shackle 3. To replace the core 8, a respective key must first be inserted into the core 8 to rotate the shackle 3, so that the recess 31 is aligned with the hole 22. Then, a proper tool can be inserted into the hole 22 through the recess 31 to unscrew the screw 9 from the threaded hole 82 of the lock core 8. Thereafter, the lock core 8 can be removed and replaced with another lock core. When the lock is locked or unlocked, the hole 22 is shielded by the shackle 3. This prevents unauthorized disassembly.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A ring-shaped hanging lock, comprising:

a casing with an open portion, a first opening and a second opening;

a ring-shaped shackle with an open portion, the shackle being located within the casing, the shackle being slidable within the casing between an open position, an intermediate position and a closed position, the open portion of the shackle being aligned with the open portion of the casing when the shackle is in the open position, the open portion of the casing being closed by the shackle when the shackle is in the intermediate and closed positions, the second opening of the casing being obstructed by the shackle such that a tool cannot be inserted into the casing through the second opening when the shackle is in the open and closed positions;

a latch which is movable between a locked position and an unlocked position, the latch being located within the casing, the latch being in the locked position and engaged with the shackle so as to prevent the shackle from moving to the intermediate position when the shackle is in the closed position, the latch being disengaged from the shackle when the latch is in the unlocked position;

a control cam for moving the latch from the locked position to the unlocked position and for moving the shackle, the control cam being located within the casing;

a replaceable core for operating the control cam, the core being located within the casing; and securing means for securing the core within the casing, the securing means being aligned with the second opening of the casing such that the securing means can be operated upon by the tool to permit removal of the core from the casing through the first opening when the shackle is in the intermediate position.

2. The lock of claim 1, wherein the securing means includes a core receiving plate with an opening for receiving the core, the core receiving plate being located within the casing, the core receiving plate including a locking hole, the core including a hole which is aligned with the locking hole, the securing means further including a screw which is threaded into the locking hole and the core hole, the screw being removable from the core hole by the tool when the shackle is in the intermediate position.

3. The lock of claim 2, wherein the shackle includes an edge which is engaged by the latch when the latch is in the locked position.

4. The lock of claim 3, further comprising a spring for biasing the latch toward the locked position.

5. The lock of claim 2, wherein the control cam is rotatably mounted within the casing.

6. The lock of claim 5, wherein the core includes a control rod for rotating the control cam, the control cam including a drive hole for receiving the control rod.

7. The lock of claim 5, wherein the axis of rotation of the control cam is generally perpendicular to the shackle, the first hole being generally parallel to the axis of rotation of the control cam, the second hole being generally perpendicular to the first hole.

8. The lock of claim 2, wherein the core receiving plate includes a main portion and a support plate for supporting the core, the locking hole being located in the support plate, the support plate being generally perpendicular to the main portion of the core receiving plate.

9. The lock of claim 2, wherein the lock includes means for supporting the core within the casing, the supporting means including the core receiving plate and an associated plate, the associated plate being connected to the core receiving plate, the associated plate being engaged with the casing.

10. The lock of claim 9, further comprising pins for connecting the associated plate to the core receiving plate.

11. The lock of claim 2, wherein the core is key operated.

12. The lock of claim 2, wherein the core hole is threaded.

13. The lock of claim 2, wherein the shackle includes a recess which is aligned with the second opening of the casing when the shackle is in the intermediate position.

14. The lock of claim 2, wherein the lock is disk shaped.

15. The lock of claim 14, wherein the open portion of the casing is U-shaped.

* * * * *